United States Patent [19]

Cude et al.

[11] Patent Number: 4,918,784

[45] Date of Patent: Apr. 24, 1990

[54] T-HANDLE TURNER

[76] Inventors: Richard J. Cude, 102 S. 300 East, Copperton, Utah 84005; Joseph N. King, 2189 W. 12974 South, Riverton, Utah 84065

[21] Appl. No.: 357,097

[22] Filed: May 26, 1989

[51] Int. Cl.[5] ..... A47B 95/02

[52] U.S. Cl. ..... 16/114 R; 16/110 R; 74/545; 403/17

[58] Field of Search ..... 16/114 R, 117, 110 R, 16/111 R, DIG. 24, DIG. 25; 74/545; 403/17

[56] References Cited

U.S. PATENT DOCUMENTS 4,161,891 7/1979 Bossert ..... 16/114 R
4,615,236 10/1986 Boots ..... 74/545

FOREIGN PATENT DOCUMENTS 2066136 7/1981 United Kingdom ..... 16/114 R

*Primary Examiner*—Richard K. Seidel
*Assistant Examiner*—James Miner
*Attorney, Agent, or Firm*—M. Ralph Shaffer

[57] ABSTRACT

A turner device for T-handles, especially for the types of T-handles employed in soft drink dispenser machines. The T-handle herein is in the form of a crank, having an eccentrically mounted rotatable handle and being provided with a principal hollow body in the form of a channel, but having a retainer plate. A spring is provided for receiving the base or shaft of the T-handle and for correctly positioning the same. The body of the T-handle is designed to releasably receive the top or T-bar of the handle such that the user of the device may conveniently rotate the handle by simply use of thumb and finger pressure on the handle so as to rotate the T-bar turner device and hence the T-handle releasably contained therein.

3 Claims, 1 Drawing Sheet

T-HANDLE TURNER

FIELD OF INVENTION

The present invention relates to T-handles used in the securement of doors of soft drink dispensers, for example, and more particularly provides a turner device which can be easily slipped over the crossbar of the handle to aid in rotation of the same without undue risked exertion.

BACKGROUND AND BRIEF DESCRIPTION OF PRIOR ART

In the past, many types of cabinets such as those associated with the soft drink industry have hinged panels which are releasably secured, for security purposes, to the rest of the structure by means of a threaded T-handle. Customarily the handle will include a lock mechanism so that unauthorized persons will be unable to rotate the T-handle in a manner to unlock the door of the dispenser cabinet.

It is very time consuming for personnel servicing the soft drink dispensers, for example, to counter rotate the T-handle in a manner to disengage its threads from the remainder of the cabinet structure. A series of half turns are needed for this operation, and this requires extensive and repeated wrist manipulations.

It would be desirable, of course, if there could be a device designed to slip over the crossbar of the T-handle such that the otherwise required wrist action could be supplanted by use of an eccentrically mounted rotatable handle whereby the T-handle can be easily spun out of engagement with its threaded connection in the cabinet.

No prior art is known in the patent or other literature whereby a suitable cranking device is releasably slipped over the crossbar of a T-handle in a manner to accomplish the objects of the invention.

BRIEF DESCRIPTION OF INVENTION

In accordance with the principles of the present invention, the T-handle turner thereof is formed with a hollow body and an eccentrically mounted rotatable handle secured thereto. The body is hollow to receive the crossbar of a T-handle, and its base is cut away or otherwise made open such that the central shaft of the T-handle can proceed into and extend centrally from the device. A strap or uncut portion of the basic member of the device retains the T-handle in position; in instances where the T-handle crossbar has ends which are of sloping of chamfered nature, then a downwardly bent tongue is used to engage such slanted or chamfered portions of such ends.

A spring is secured to the underside of the principal member of the turner device, and the spring is shaped to releasable receive and centrally engage for positionment the shaft of the T-bar handle.

OBJECTS

Accordingly, a principal object of the present invention is to provide a convenient device for releasably engaging the top portion of a T-bar handle such that the usually required multiple wrist motions needed to rotate the T-bar handle can be circumvented; rather, the device to be employed will require only slippage over the crossbar of the T-bar handle and a crank-like rotatable knob used to spin the T-bar handle in a desired direction.

A further object of the invention is to provide a new and useful T-bar handle turner.

An additional object is to provide a turner device for T-handles which can be easily installed and removed, and also manipulated at the desired times in a convenient manner so as to reduce efforts of T-handle manipulation to a minimum.

BRIEF DESCRIPTION OF DRAWINGS

The present invention, both as to its organization and manner of operation, may best be understood be reference to the following detailed description taken in conjunction with the drawings in which.

DETAILED DESCRIPTION OF PREFERRED EMBODIMENTS

Figure 1:
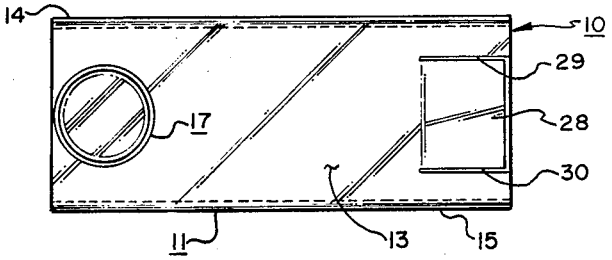
FIG. 1 is a top plan of a T-handle turner constructed in accordance with the principles of the present invention.
Figure 2:
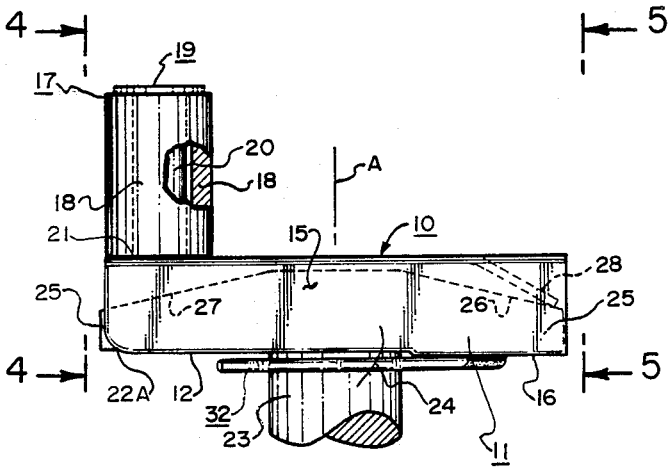
FIG. 2 is a side elevation, partially broken away, of the turner structure of FIG. 1.

In FIGS. 1–5 the T-handle turner or turner device 10 is shown to include a hollow body 11. Hollow body 11 can comprise simply a metal tubular extrusion, preferably of generally rectangular cross section. In such event, a lower portion or underside 12 thereof will be milled away so as to provide a strap or retainer plate 16 at the bottom or underside 12 of the body. In any event, hollow body 11 will have a top 13, sides 14 and 15, and a bottom which will be open but include the retainer plate 16. Where the hollow body 11 simply comprises a channel, then the retainer plate 16 can be a separate plate welded or otherwise secure across the open underside of such channel.

Relative to the transverse axis of rotation A of the device, there will be an eccentrically mounted handle 17 which generally will take the form of a sleeve 18 revolvably mounted upon pin 19. The shank 20 of pin 19 will be secured in a suitable provided aperture at 21 within the top 13 of hollow body 11. Accordingly, by the user grasping the sleeve 18 with him thumb and finger, he may conveniently rotate, either in a counterclockwise or clockwise direction, the device about operating axis A.

Whether the hollow body is fabricated from channel or tubular stock, open area 22 is to be provided, and hence will provide access for the receipt of the riser, base or shaft 23 of T-bar handle 24. The crossbar 25 of T-bar handle 24 will be integral with the shaft 23 and generally will be sloping or chamfered at 26 and 27 proximate its ends. Conventional T-bar handles are so constructed. When such is the case in connection with use of the device of the present invention, then preferably a depending tongue 28 will be provided as formed by slits 29 and 30, and such tongue will be bent downwardly to conform to the upper surface of a respective chamfered end at 26.

As to retainer plate 16, the same will have braised, welded or otherwise secured thereto, a central portion 31 of positioning spring 32. Spring 32 will have attachment Portion 33, and also oppositely formed legs 34 and 35 each of which will have respective outwardly curved ends 36 and 37. Centrally curved portions 38 and 39 of the legs will be generally arcuately curved, preferably cylindrical in nature, and be contoured to grasp the riser or base of shaft 23 as is seen by the dotted line 23 in FIG. 3.

Figure 4:
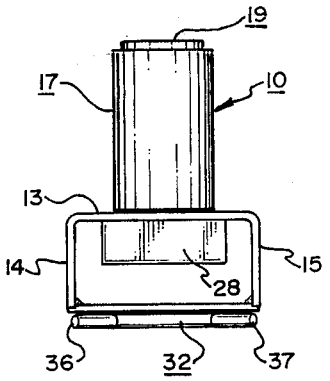
FIG. 4 is an end elevation taken along the line 4—4 in FIG. 2.
Figure 5:
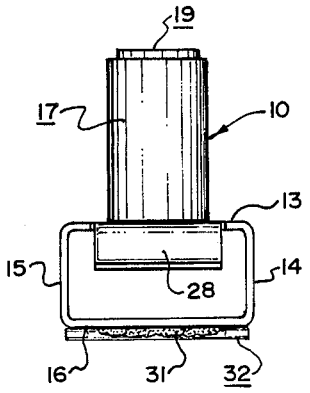
FIG. 5 is an end elevation taken along the line 5—5 in FIG. 2.

FIGS. 4 and 5 illustrate opposite end views or elevations of the T-handle turner device 10.

If desired, an aperture 38' may be provided in the hollow body 11 so as to accommodate the carrying of the device on a belt hook or key chain, for example.

Figure 3:
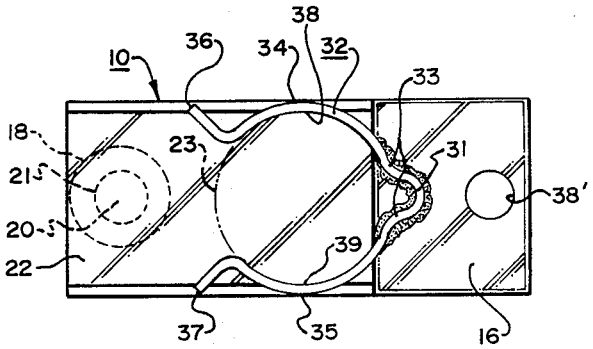
FIG. 3 is a bottom view of a turner device of the present invention.

It is noted that the opening 22 in FIG. 3 is contiguous with the slit or open area 22A, or forms a part thereof, relative to the hollow body 11.

OPERATION

In operation, a retail cooling cabinet dispenser for soft drinks will be provided with the customary T-bar handle 24. It is to be noted that the forward panel of the dispenser will lie in a vertical plane; hence, in actual use the structure FIG. 2 will be rotated 90 degrees in a clockwise direction relative to the depiction shown thereat in the drawings. In any event, in the absence of the T-handle turner, the user, to unscrew the T-bar handle, will have to use a series of successive wrist motions and continual replacements of his hand so that the threaded area of the shank of the T-bar handle may become disengaged with a corresponding threaded portion of the cabinet. In lieu of this procedure, the serviceman by being equipped with the Present T-handle turner 10, can simply slip the hollow body 11 over the crossbar of the T-bar handle, with the slit 22A and open area 12 allowing for progression of the shank, riser base or shaft 23 of the T-bar handle to proceed to a point centrally of the hollow body 11 and aligned with operating axis and rotation A. If, for example, the lateral cross section of the T-bar handle is rectangular and uniform throughout, then the open area of hollow body 11 can be designed to match in correspondence therewith.

In cases where, as at present, the opposite ends are chamfered or sloped downwardly as shown by the areas at 26 and 27, then the design may include tongue 28 which will engage portion 26 and thereby aid in stabilizing the T-bar handle crossbar within hollow body 11.

In the advance of the shaft of the T-bar handle as above described, the same will proceed into spring 32 such that areas 38 and 39 thereof will engage the opposite curved surfaces of the T-bar handle shank or shaft. This tends to keep in relative alignment the center of the T-bar handle with axis A of the turner.

When the above has been accomplished, then the user need only grasp sleeve 18 by his thumb and finger and rapidly turn the same either in counter clockwise or in clockwise directions, respectively, so as to achieve a disengagement of the T-bar handle, or a re-engagement thereof with the corresponding threaded portion (not shown) of the cabinet.

Any type of rotatable handle can be employed, so long as the same is eccentrically mounted, i.e. distanced from the axis of rotation A of the device.

While particular features of the present invention have been shown and described, it will be obvious to those skilled in the art that various changes and modifications may be made without departing from the true spirit and scope of the invention; hence, the claims depended hereto define further objects and advantages of the invention and are set forth below:

We claim:

1. A T-handle turner device including, in combination, a hollow elongate body, designed for releasably receiving a crossbar of an external T-handle, the cross bar being provided with a shaft, said body having a partially open underside and also a central transverse axis of rotation; a rotatable handle pivotally mounted to said body opposite said underside and spaced from said axis; and spring means secured to said body proximate said underside for releasably receiving and constraining said shaft of said external T-handle, whereby to position the same in central alignment with said axis of rotation.

2. A T-handle turner device including, a hollow body having a partially open underside and a central transverse axis of rotation, said body having a top provided with an angularly depending tongue for engaging the contoured portion of an external T-handle said hollow body being provided with a rotatable handle pivotally mounted to said opposite said underside and spaced from said axis, and spring means secured to said body for releasably gripping the shaft of an external T-handle for alignment with said axis.

3. In combination, a T-handle having a shaft and a crossbar integral therewith and transverse thereto; and a T-handle turner having a hollow body releasably receiving said crossbar, having a transverse central axis, and provided with spring means for releasably retaining said shaft, said hollow body being provided with an eccentrically mounted rotatable handle spaced from the central axis of said hollow body, same hollow body also being recessed to receive the progression of said shaft as said T-handle crossbar is received in said hollow body.

* * * * *